US008919147B2

(12) United States Patent
Wolk et al.

(10) Patent No.: US 8,919,147 B2
(45) Date of Patent: Dec. 30, 2014

(54) COLLECTION CONTAINER FOR A HEAT EXCHANGER AND ASSOCIATED HEAT EXCHANGER

(75) Inventors: Gerrit Wolk, Stuttgart (DE); Markus Pflieger, Stuttgart (DE); Siegfried Tews, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 2338 days.

(21) Appl. No.: 11/660,081

(22) PCT Filed: Nov. 15, 2004

(86) PCT No.: PCT/EP2004/012932
§ 371 (c)(1),
(2), (4) Date: Jul. 21, 2008

(87) PCT Pub. No.: WO2005/052470
PCT Pub. Date: Jun. 9, 2005

(65) Prior Publication Data

US 2008/0314075 A1 Dec. 25, 2008

(51) Int. Cl.
*F25B 39/04* (2006.01)
*F25B 40/02* (2006.01)

(52) U.S. Cl.
CPC ..... *F25B 39/04* (2013.01); *F25B 2400/162* (2013.01); *F25B 40/02* (2013.01); *F25B 2339/0446* (2013.01); *F25B 2500/01* (2013.01); *F25B 2339/0441* (2013.01)
USPC ..... 62/509; 62/513

(58) Field of Classification Search
CPC .. F25B 39/04; F25B 40/02; F25B 2339/0446; F25B 2339/0441; F25B 2500/01; F25B 2400/162
USPC ..... 62/509, 474, 475, 513; 165/41, 174, 165/175
See application file for complete search history.

(56) References Cited

U.S. PATENT DOCUMENTS

| | | | | |
|---|---|---|---|---|
| 5,546,761 | A | 8/1996 | Matsuo et al. | |
| 5,628,206 | A | 5/1997 | Baba | |
| 5,709,106 | A * | 1/1998 | Inaba et al. | 62/507 |
| 5,901,573 | A * | 5/1999 | Kobayashi | 62/507 |
| 5,946,940 | A | 9/1999 | Inoue | |
| 6,158,503 | A * | 12/2000 | Gille et al. | 165/132 |
| 6,397,627 | B1 | 6/2002 | Aki et al. | |

(Continued)

FOREIGN PATENT DOCUMENTS

| | | |
|---|---|---|
| DE | 102 13 194 A1 | 10/2003 |
| FR | 2 747 768 | 10/1997 |
| WO | WO 02/18853 A1 | 3/2002 |
| WO | WO 02/077548 A1 | 10/2002 |

*Primary Examiner* — Mohammad M Ali
(74) *Attorney, Agent, or Firm* — Greer, Burns & Crain, Ltd.

(57) ABSTRACT

A collection container for a heat exchanger, in particular for a refrigerant condenser of a motor vehicle, the collection container having at least one inlet opening for a fluid, in particular refrigerant, and the collection container having at least one outlet opening for the fluid, in which in addition the outer jacket of the collection container limits a cross-sectional surface of the internal chamber in each of a number of cross-sections regarded perpendicular to the longitudinal direction of the collection container, and in which the surface content of these cross-sectional surfaces of the internal chamber limited by the outer jacket has different sizes in at least two cross-sections situated at a distance from one another in the longitudinal direction of the collection container.

34 Claims, 14 Drawing Sheets

(56) References Cited

U.S. PATENT DOCUMENTS 6,470,704 B2 * 10/2002 Shibata et al. ..... 62/509
6,589,320 B2 * 7/2003 Incorvia et al. ..... 96/147
6,622,517 B1 * 9/2003 Whitlow et al. ..... 62/474
6,640,582 B2 * 11/2003 Incorvia et al. ..... 62/474
6,679,319 B1 * 1/2004 Kato ..... 165/132
2003/0085026 A1 5/2003 Kaspar et al.

* cited by examiner 112
116
114
36
68
10
28
24
30
70
34
40
12
16
14
132
110
130
1

26
10
28
24
112
116
114
100
108
20
122
120
1

COLLECTION CONTAINER FOR A HEAT EXCHANGER AND ASSOCIATED HEAT EXCHANGER

BACKGROUND

The present invention relates to a collection container for heat exchangers, and in particular for refrigerant condensers of a motor vehicle, as well as to a heat exchanger that is preferably constructed as a refrigerant condenser of a motor vehicle. Refrigerant condensers for motor vehicles are known, as are collection containers for such refrigerant condensers.

Standardly, such refrigerant condensers have two headers as well as a pipe-fin block situated therebetween. Both ends of the pipes of the pipe-fin block debouch in one of the two headers, so that a refrigerant connection is created between the headers.

In addition, they have a collection container situated adjacent to one of the headers, in which a dryer is situated that is made up for example of a dryer cartridge and a filter. The dryer can extract liquid (water) from the refrigerant, and the filter cleans the refrigerant of particles that can enter into the refrigerant due for example to wear or the like. One of the two headers and the collection container are connected via two overflow openings or ducts. Via one of these overflow ducts, refrigerant can flow from the header into the collection container, and via the other overflow opening it can flow back. Both of these overflow openings are situated in the lower end area of the collection container. A pipe that forms a jacket wall of the collection container has a constant inner diameter as well as a constant outer diameter, or a constant inner circumference and a constant outer circumference, seen in cross-section perpendicular to the longitudinal direction.

The collection container has essentially the same length as the adjacent header.

From U.S. Pat. No. 5,546,761, a heat exchanger is known in which the collection container is shorter than the adjacent header. Here, the collection container has an essentially constant inner diameter and outer diameter.

SUMMARY

The object of the present invention is to create a header, and a heat exchanger, in particular a refrigerant condenser, having a header, that can be easily manufactured and easily adapted to installation space requirements.

This object is achieved by a collection container according to claim 1 or according to the independent claims, as well as by a heat exchanger according to Claim 25 or according to the independent claims. Preferred constructions are the subject matter of the subclaims. The outer jacket is formed in particular by one or more pipes. These can for example have a constant wall thickness. They can for example be hollow cylindrical pipes. However, they can also have a different cross-sectional surface. Preferably, the walls of such pipes are oriented parallel to the longitudinal axis of the collection container.

An outer jacket of the collection container limits in particular the collection container in the direction perpendicular to its longitudinal direction, in particular circumferentially. An outer jacket can in particular be an outer jacket wall; such an outer jacket wall can in particular have a plurality of pipes and is preferably formed in one piece. Pipe-shaped parts are in particular pipes.

It can be provided that a dryer-filter device is introduced into the collection container before or after the soldering oven.

It can also be provided that the collection container is welded at the top by a cover or the like.

In another preferred specific embodiment, the cover of the collection container is situated removably, so that in particular the dryer-filter device can be introduced into the collection container after the soldering process, or can also be exchanged at a later time.

The present invention enables a variable adaptation to installation space requirements, in particular those of the automobile manufacturer. Thus, for example, in certain situations, from the point of view of crash tests it can also make sense for the collection container not to have a constant outer dimension.

In addition, in the following the collection container is preferably situated such that the larger outer diameter is situated at the top and the smaller outer diameter is situated at the bottom. However, it is also within the scope of the present invention to rotate this, in order in particular to enable observance of the required maximum dimensions for installation in a motor vehicle.

In a preferred construction, the collection container essentially has the same length as the first header.

BRIEF DESCRIPTION OF THE DRAWINGS

In the following, examples are explained on the basis of the Figures.

FIG. 12 shows an exemplary specific embodiment of the present invention in a schematic view;

FIG. 13 shows a side view of the construction according to FIG. 12;

FIG. 14 shows the construction according to FIG. 12 in a top view;

DETAILED DESCRIPTION OF THE PREFERRED EMBODIMENT

Figure 1:
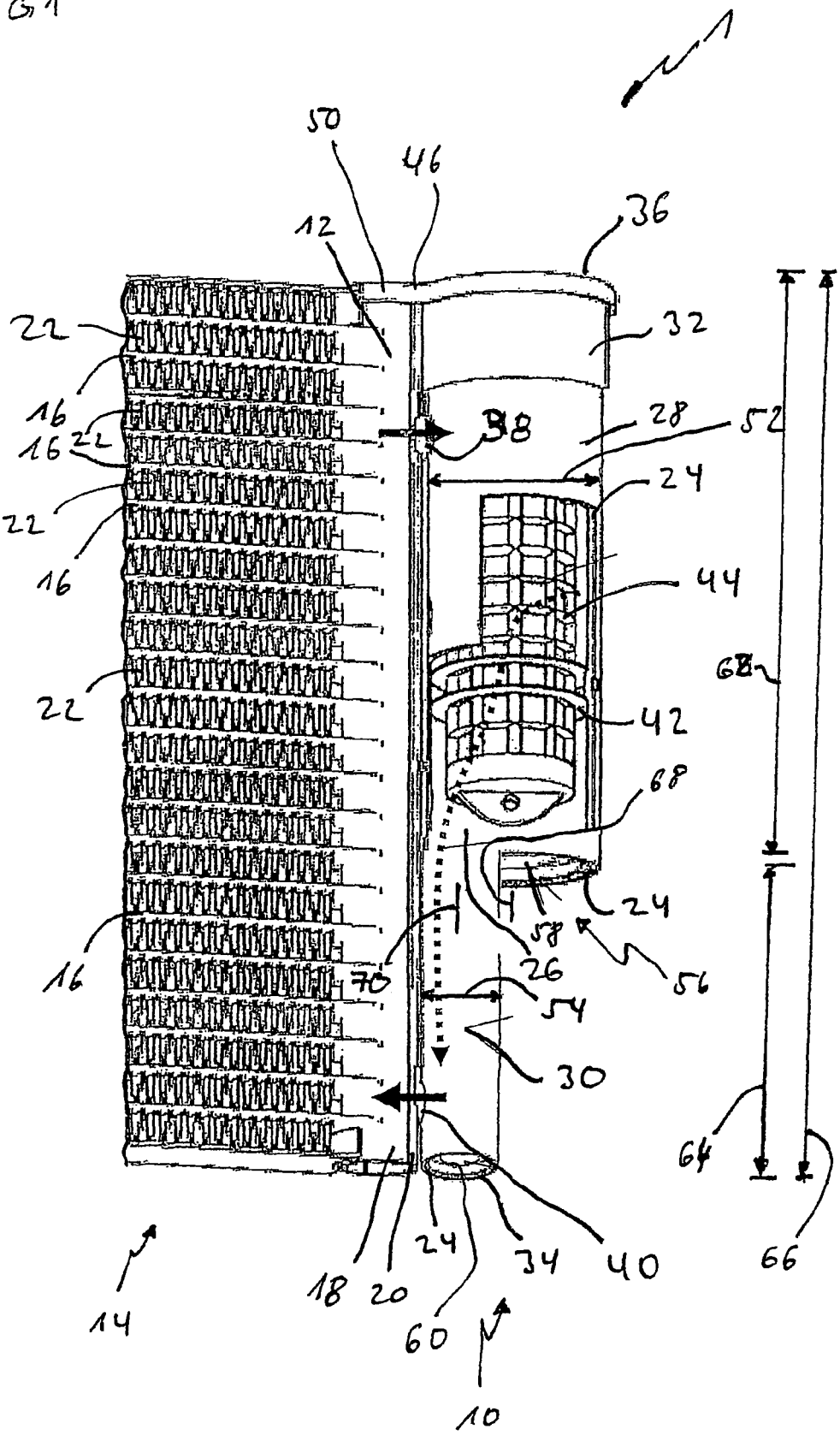
FIG. 1 shows a first exemplary specific embodiment of the present invention in a partial, schematic view.

FIG. 1 shows an exemplary heat exchanger 1 according to the present invention having an exemplary collection container 10 according to the present invention, in a schematic partial view.

Heat exchanger 1 has collector or collection container 10, a first header 12, and a second header (not shown), as well as a pipe-fin block 14. Pipe-fin block 14 has a multiplicity of pipes 16 situated in parallel that are formed for example as flat pipes, extend in a straight line, and are received with their respective first ends in first header 12. For this purpose, openings fashioned as slits are provided in first header 12, facing the pipe-fin block, that receive these pipe ends. The pipe ends can, if necessary, protrude slightly into header 12. The second ends (not shown in FIG. 1) of pipes 16 of pipe-fin block 14 are correspondingly received by the second header (not shown), so that via pipes 16 a flow connection exists between first header 12 and the second header.

The headers can each be assembled from a base part I 8 and a cover part 20, each fashioned as a half shell. Here, each base part 18 faces pipe-fin block 14, and cover part 20 faces away from this pipe-fin block 14. Collection container 10 is situated adjacent to first header 12, and extends essentially parallel to this first header 12. Collection container 10 is essentially situated on the side of first header 12 facing away from the pipe-fin block. It can also be situated so as to be pivoted, in particularly slightly, in the direction of this pipe-Fin block.

On the second header (not shown), a collection container 10 of this sort is not provided.

The second header is sealed above and below by suitable seals. For example, here non-detachable covers can be used. Detachable covers could also be provided. Non-detachable covers can be in particular soldered or welded.

In a preferred construction, heat exchanger 1 or collection container 10 is used for a refrigerant condenser for a motor vehicle air-conditioning system.

Here, refrigerant flows through pipes 16, so that a refrigerant connection exists via pipes 16 between first header 12 and the second header. It can be provided that in the headers a plurality of separating intermediate walls are placed perpendicular to the longitudinal axis of the headers, so that the refrigerant is conducted in a serpentine fashion through pipes 16 and through the two headers. It can also be provided that a plurality of pipes 16 are positioned between two such separating walls situated in the same header. The separating walls can for example be flat and oriented perpendicular to the longitudinal axis of the header; however, they can also have a different shape and be differently oriented, for example obliquely to the longitudinal axis of the relevant header. Such separating walls can for example be manufactured separate from the header or the cover and the base, and can be soldered in the header, for example in the soldering oven. Preferred flow guidance patterns that can be brought about in particular with the aid of such separating walls are explained in more detail below on the basis of FIG. 3.

Between the pipes 16 of pipe-fin block 14, fins 22 are situated through which air can flow, in particular transverse to the direction of longitudinal extension of pipes 16.

Collection container 10 has an outer jacket 24 that limits this collection container or interior chamber 26 of the collection container radially outward. This outer jacket 24 thus sheaths, as it were, interior chamber 26 of collection container 10. The outer jacket is formed by the wall segments or walls respectively situated externally or radially externally, and can also be designated the outer jacket wall. In this context, it is to be noted that the jacket need not be formed from a wall manufactured in one piece. It is preferably provided that, as is also further indicated below, different pipes or the like are connected to one another in order to form the outer jacket or outer jacket wall. Such pipes can also be built on one pipe, which has a relatively small outer dimension and is inserted with its end area into another pipe, which has a correspondingly larger inner dimension, so that these pipes overlap, seen in the longitudinal direction. In such a case, for example the (outer) wall of the inserted pipe should form, outside the area of overlap, the outer jacket, or a segment of the outer Jacket, of collection container 10, while the (outer) wall of the other pipe likewise forms an outer jacket or outer jacket segment of collection container 10. If a plurality of such pipes are inserted onto one another in a corresponding manner, the same holds correspondingly.

In the construction according to FIG. 1, outer jacket 24 of collection container 10 is formed by a first pipe 28 as well as by a second pipe 30, if necessary using a profile piece 32. It is also possible (though not shown in FIG. 1) to use more than two pipes to form the outer jacket.

In the construction according to FIG. 1, pipes 28 and 30 are manufactured separately. Profile piece 32 is also manufactured separately.

Profile piece 32 can be for example an extruded part.

Pipes 28 and 30 can be manufactured in the same way or in different ways. They can for example each be welded from semi-finished parts. However, they can also be manufactured in a different manner.

Pipes 28 and 30 are fashioned with thin walls. They can for example have a wall thickness that is essentially adapted to the pressures or burst pressures that occur in interior chamber 26 during operation; i.e., they can be dimensioned so that they withstand these pressures. For example, profile piece 32 can have a greater wall thickness than pipes 28 and 30. Pipes 28 and 30 can have the same wall thickness or can have different wall thicknesses. The wall thickness of first pipe 28 is preferably constant along the length of this pipe, as well as along the circumference. The wall thickness of second pipe 30 is also essentially constant along its circumference as well as along its length. However, varying wall thicknesses can also be provided.

In the construction according to FIG. 1, pipes 28 and 30 each have a hollow cylindrical construction. In the construction according to FIG. 1, the walls of these pipes, or the hollow cylindrical wall of these pipes, is such that it runs essentially parallel to the longitudinal axis of the collection container. However, it can also be provided that pipes 28 and 30 have different cross-sectional surfaces and/or have segments of their wall that run non-parallel to the longitudinal axis of collection container 10.

For example, first pipe 28 and/or second pipe 30 can have a triangular, rectangular, or greater polygonal cross-section, or can have an elliptical cross-section. It can also be provided that the cross-sectional shape of one or both of these pipes 28, 30 is different internal and externally, i.e., at the inner surface or outer surface. For example, it can be provided that the inner surface is essentially round or circular, and the outer surface is elliptical in its cross-section.

In a particularly preferred construction, however, as is also shown in FIG. 1, it is provided that first pipe 28 and second pipe 30 both have a hollow cylindrical construction.

First profile piece 32 is situated in a (second) end area of collection container 10, facing away from first end 34. This is the upper end area, while first end 34 of collection container 10 is the lower end. Profile piece 32 extends essentially up to the second, or upper, end 36 of collection container 10.

Profile piece 32 is essentially round in its shape, and essentially has a cylindrical outer jacket surface; holders or support surface parts or the like, supported for example on first header 12, can also be integrally formed externally on the profile piece. On its inside, this profile piece has a profiling that is further explained below on the basis of FIG. 2.

Between collection container 10 and first header 12, overflow openings or overflow ducts 38, 40 are provided. Overflow opening 38 or overflow duct 38 makes it possible for fluid or refrigerant to flow from collection container 10 into first header 12, and overflow opening or duct 40 makes it possible for fluid or refrigerant to flow from first header 12 into collection container 10, as is indicated schematically in FIG. I by corresponding arrows. Between these overflow openings 38, 40, a sealing lip 42 or a suitable dividing means is provided that prevents a direct overflow of fluid or refrigerant (passing by filter/dryer cartridge 44) from overflow opening 40 into overflow opening 38 inside collection container 10. Filter/dryer cartridge 44 is situated or accommodated in collection container 10 and has a dryer part and a filter part. The dryer part is used to extract moisture or water from the fluid or refrigerant. A granulate or powder or the like can for example be provided for this purpose. The filter part is used to remove particles from the fluid or refrigerant that may have entered the fluid or refrigerant for example as a result of wear.

Preferably, filter-dryer cartridge 44 is held detachably in a particular position in collection container 10. For this purpose, for example a force storage device, such as a spring, or elastic holding elements or the like can be provided.

Possible constructions of such a (in particular detachable) holding are disclosed in applicant's DE 103 06 192 A1, which, with reference to these constructions, are hereby incorporated through reference into the subject matter of the present disclosure as preferred constructions.

There (in DE 103 06 192 A1), dryer-filter cartridges are also disclosed; with respect to the construction of the dryer-filter cartridges, the constructions shown there are also preferred developments of the present invention, so that in this respect reference is made to DE 103 06 192 A1, which in this regard is incorporated into the subject matter of the present disclosure through reference.

First profile piece 32 is placed on first pipe 28 of collection container 10 and is soldered thereto.

Figure 2:
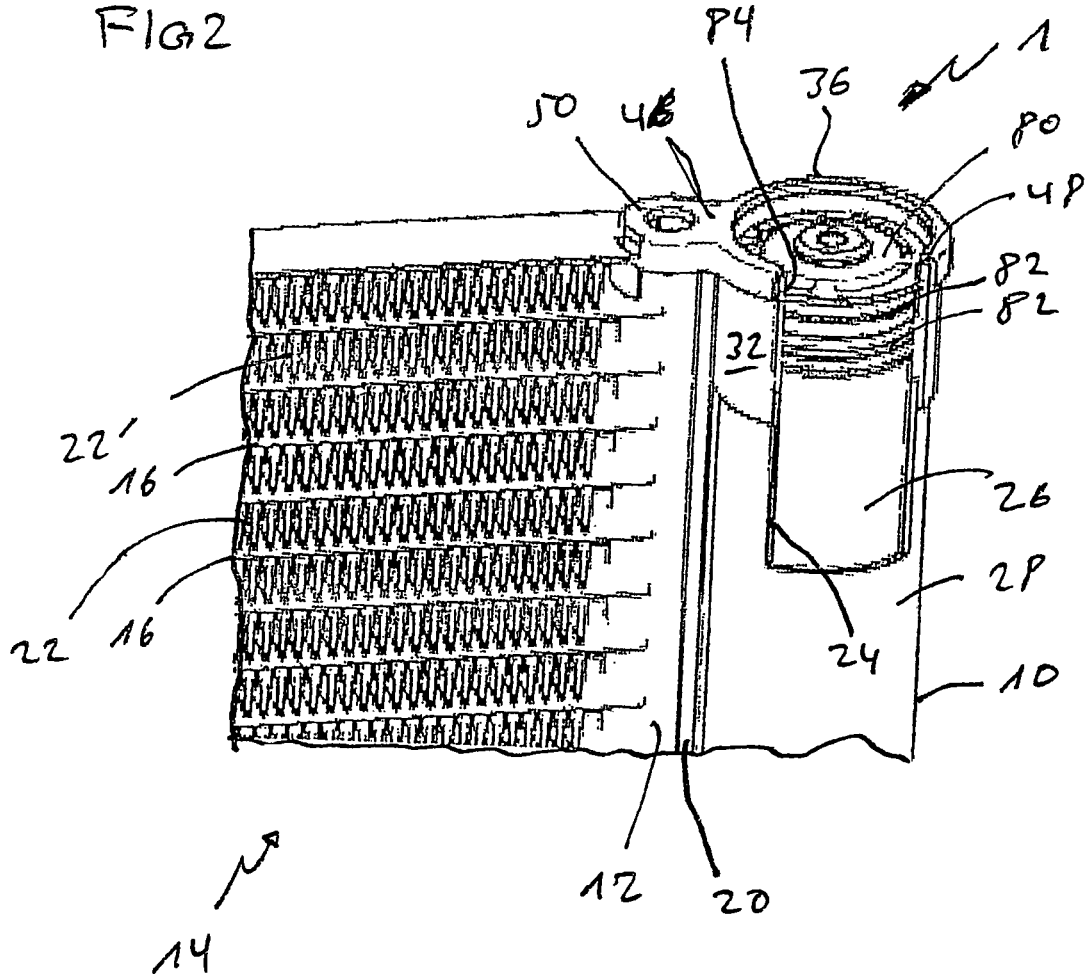
FIG. 2 shows a partly sectional detail from the construction according to FIG. 1.

In the area of second end 36, i.e. the upper end, of collection container 10, an annular holder 46 is provided. This annular holder surrounds collection container 10, or first profile piece 32 thereof, at least partially; here the surrounding is around the complete circumference. As FIG. 2 shows, this annular holder 46 has an offset 48 that extends slightly on the face of profile piece 32. This annular holder 46 also has a continuation 50 that engages in the upper end or upper area of first header 12. In this area, continuation 50 of annular holder 46 can at the same time form a cover for the sealing of this first header 12. In addition or alternatively, it can also surround first header 12 externally. In addition, it can be inserted into the opening on the face of the header so as to jam it. Preferably, annular holder 46 receives both first header 12 and also collection container 10 or first profile piece 32, in particular in blocking fashion. By means of such an annular holder 46, first header 12 can be held on collection container 10 or on first profile piece 32; i.e., the positioning of collection container 10 relative to first header 12 takes place via this annular holder, at least in the upper area. In a soldering process in a soldering oven, annular holder 46 can then be soldered to first header 12 and to collection container 10 or first profile piece 32. This can for example take place in such a way that first header 12 is sealed at its upper end by the soldering.

Before introduction into a collector oven, soldering points or adhesive points for pre-fixing can also be provided, in the named area or at other locations, in particular in areas in which a soldered connection is produced in the soldering oven.

Collection container 10 has an outer jacket 24 that limits this collection container, or the interior chamber 26 of the collection container, radially outwardly. This outer jacket 24 thus as it were sheaths interior chamber 26 of collection container 10. The outer jacket is formed by the respectively externally or radially externally situated wall segments or walls, and can also be designated the outer jacket wall. In this context, it is to be noted that the jacket need not be formed wall manufactured in one piece. It is preferably provided that, as is also shown below, different pipes or the like are connected to one another in order to form the outer jacket or outer jacket wall. Such pipes can also be built on one pipe, which has a relatively small outer dimension and is inserted with its end area into another pipe having a correspondingly larger inner dimension, so that these pipes overlap, seen in the longitudinal direction. In such a case, for example the (outer) wall of the inserted pipe, outside the area of overlap for us, the outer jacket, or a segment of the outer jacket, of collection container 10, while the (outer) wall of the other pipe likewise forms an outer jacket or outer jacket segment of collection container 10. If a plurality of such pipes are fitted onto one another in a corresponding manner, the same holds correspondingly.

In the construction according to FIG. 1, outer jacket 24 of collection container 10 is formed by a first pipe 28 as well as by a second pipe 30, if necessary using a profile piece 32. It is also possible (though not shown in FIG. 1) to use more than two pipes to form the outer jacket.

In the construction according to FIG. 1, pipes 28 and 30 are manufactured separately. Profile piece 32 is also manufactured separately.

Profile piece 32 can be for example an extruded part.

Pipes 28 and 30 can be manufactured in the same way or in different ways. They can for example each be welded from semi-finished parts. However, they can also be manufactured in a different manner.

Pipes 28 and 30 are fashioned with thin walls. They can for example have a wall thickness that is essentially adapted to the pressures or burst pressures that occur in interior chamber 26 during operation; i.e., they can be dimensioned so that they withstand these pressures. For example, profile piece 32 can have a greater wall thickness than pipes 28 and 30. Pipes 28 and 30 can have the same wall thickness or can have different wall thicknesses. The wall thickness of first pipe 28 is preferably constant along the length of this pipe, as well as along the circumference. The wall thickness of second pipe 30 is also essentially constant along its circumference as well as along its length. However, varying wall thicknesses can also be provided.

In the construction according to FIG. 1, pipes 28 and 30 each have a hollow cylindrical construction. In the construction according to FIG. 1, the walls of these pipes, or the hollow cylindrical wall of these pipes, is such that it runs essentially parallel to the longitudinal axis of the collection container. However, it can also be provided that pipes 28 and 30 have different cross-sectional surfaces and/or have segments of their wall that run non-parallel to the longitudinal axis of collection container 10.

For example, first pipe 28 and/or second pipe 30 can have a triangular, rectangular, or greater polygonal cross-section, or can have an elliptical cross-section. It can also be provided that the cross-sectional shape of one or both of these pipes 28, 30 is different internal and externally, i.e., at the inner surface or outer surface. For example, it can be provided that the inner surface is essentially round or circular, and the outer surface is elliptical in its cross-section.

In a particularly preferred construction, however, as is also shown in FIG. 1, it is provided that first pipe 28 and second pipe 30 both have a hollow cylindrical construction.

In the construction according to FIG. 1, first pipe 28 of collection container 10 has a larger outer diameter than does second pipe 30 of collection container 10, so that outer jacket 24 of collection container 10 has two different outer diameters. The outer diameter of first pipe 28 of collection container 10 is schematically indicated in FIG. 1 by double arrow 52, and the outer diameter of second pipe 30 of collection container 10 is schematically indicated in FIG. 1 by double arrow 54. In particular, it can be provided that outer diameter 54 of second pipe 30 of collection container 10 is significantly smaller than outer diameter 52 of second pipe 28 of collection container 10. In a particularly preferred construction, the difference between outer diameter 52 of first pipe 28 of header 10 and outer diameter 54 of second pipe 30 of header 10 is in the range of 15-45 mm. However, other diameter differences can also be provided.

As stated, interior chamber 26 of collection container 10, or collection container 10 itself, is radially outwardly limited by first pipe 28 and second pipe 30. In the construction according to FIG. 1, it is provided that first pipe 28 of collection container 10 and second pipe 30 of collection container 10 each have an essentially cylindrical inner surface. Here is provided that the inner diameter of first pipe 28 of collection container 10 is larger than the inner diameter of second pipe 30 of collection container 10.

In the cross-section seen perpendicular to the longitudinal axis of collection container 10, in the area in which outer-jacket 24 is formed by a first pipe 28 of collection container 10 the cross-sectional surface, limited by the outer jacket, of internal chamber 26 is larger with respect to its surface content than it is in the area in which outer jacket 26 of collection container 10 is formed by second pipe 30.

Outer diameter 54 of first pipe 30 of collection container 10 is preferably smaller than 25 mm, so that the maximum outer dimension of outer jacket 26 in the area in which outer jacket 26 of collection container 10 is formed by first pipe 30 is smaller than 25 mm. Outer diameter 54 can for example be 19 mm.

In the end face area facing second pipe 30 of collection container 10, first pipe 28 of collection container 10 is partially covered by a wall segment 58. In the construction according to FIG. 1, this wall segment 58 is formed as a disc. In the construction according to FIG. 1, this disk 58 is oriented essentially perpendicular to the longitudinal axis of collection container 10. Disk 58 is inserted into the pipe end, facing second pipe 30, of first pipe 28 of collection container 10. The diameter of this disk, which is round in this instance, corresponds essentially to the diameter or inner diameter of first pipe 28, or is slightly smaller. The diameter of disk 58 is therefore similar to that of first pipe 28. In the construction according to FIG. 1, disk 58 is inserted into first pipe 28 in such a way that it has a certain distance from this pipe end. However, it can also terminate flush with this pipe end. In addition, it can be provided that wall segment 58 is formed not by a disc but rather by a placed-on cover or the like. For example, the cover can be fitted onto first pipe 28 of collection container 10; i.e., first pipe 28 of collection container 10 is inserted into the cover.

Wall segment 58 or disk 58 has an opening. First pipe 32 debouches into this opening. Pipe 30 can extend through this opening or can essentially end at the opening. The opening can be such that its circumference is limited completely by wall segment 58 or disk 58, or can be such that it is situated at an edge area of this wall segment 58, or of this disk 58, and is thus not completely closed in its radially external area. The shape and size of the opening are essentially adapted to the outer contour of second pipe 30 of the collection container.

It can be provided that second pipe 30 of collection container 10 and wall segment 58 or disk 58 are manufactured as a one-piece assembly. This assembly can be divided into two areas, namely second pipe 30 and disk 58.

In the following, reference will be made to disk 58; it is to be noted that disk 58 can also be a differently constructed wall segment, such as a cover or the like. A cover can for example also have a circumferential collar that is oriented essentially parallel to the longitudinal axis of collection container 10.

Second pipe 30 of collection container 10, and disk 58, can also be manufactured separately and connected to one another, for example soldered or welded. In particular, second pipe 30, as well as pipe 28, can also be a welded pipe.

In particular if the assembly comprising second pipe 30 and disk 58 is manufactured in one piece, this assembly can advantageously be manufactured using the extrusion molding method or extrusion method or deep-drawing method, or casting method; other manufacturing methods can also be selected essentially arbitrarily. In a preferred construction, second pipe 30 of collection container 10 is closed at its lower end, or in the area of its lower end, i.e., the end facing away from the first pipe. This can be accomplished for example by a cover or a disc or a cup or a double cover, as is indicated schematically by reference character 60.

The length of second pipe 30 and/or the length of a segment seen in the longitudinal direction of collection container 10, in which the second pipe forms outer jacket 26, can be constructed in various ways, or variably. Advantageously, this length can for example be in the range from 50 mm to 300 mm. However, other lengths are also preferred. As already stated, the assembly formed from second pipe 30 and wall segment 58 is fitted in or on first pipe 28 of collection container 10, and these are preferably soldered together. In particular, it can be provided that here a tight connection is produced. It can be provided that the connection between first pipe 28 of collection container 10 and second pipe 30 of collection container 10, which is effected here using disk 58 and by means of soldering or the like, is provided in an area that is situated at a distance of at least 20% of the overall length of collection container 10 from the two ends 36, 34 of collection container 10. In FIG. 1, the distance of this connection area from upper end 36 of collection container 10 is indicated schematically by double arrow 62, and the distance from lower end 34 is schematically indicated by double arrow 64. The overall length of collection container 10 is indicated schematically in FIG. 1 by double arrow 66. The overall length of the collection container is indicated schematically by double arrow 66.

In the construction according to FIG. 1, second pipe 30 of collection container 10 is situated eccentrically to or from first pipe 28 of collection container 10. This is also indicated by lines 68 and 70, lines 68 schematically indicating the central longitudinal axis of first pipe 28 of collection container 10, and line 70 indicating the central longitudinal axis of second pipe 30 of collection container 10.

In the construction according to FIG. 1, second pipe 30 is situated eccentrically to first pipe 28 in such a way that it faces first header 12, though this can also be realized differently. In the construction according to FIG. 1, this eccentric situation of first pipe 28 of collection container 10 has essentially the same distance from first header 12 as does second pipe 30 of collection container 10. However, these distances can also be different. In particular, it can be provided that first pipe 28 has a smaller distance from first header 12 than does second pipe 30 of collection container 10.

Particularly preferably, the distance from central longitudinal axis 70 of second pipe 30 of collection container 10 to the central longitudinal axis of first header 12 is smaller than the distance from central longitudinal axis 68 of first pipe 28 of collection container 10 to the central longitudinal axis of first header 12.

However, it can also be provided, as is also shown below by the Figures, that second pipe 30 of collection container 10 is situated essentially concentrically to first pipe 28 of collection container 10.

In the construction according to FIG. 1, the entry of the fluid or heat exchanger medium or refrigerant (in the following, for simplification this is referred to simply as "refrigerant") into collector or collection container 10 takes place above sealing lip 42 of dryer cartridge 44. After the entry of the refrigerant into header 30, the refrigerant flows above sealing lip 42 into dryer cartridge 44, and subsequently flows through the dryer cartridge and exits from dryer cartridge 44 underneath sealing lip 42. Subsequently, the refrigerant flows through the assembly of collection container 10 formed by disk 58 and by second pipe 30 of the collection container, and from there flows into first header 12. Here this is such that the refrigerant enters from collector 10 into first header 12 through the overflow opening or overflow duct. The entry of the refrigerant from first header 12 into collection container 10 takes place via the overflow opening or overflow duct 38. In a preferred construction, overflow opening or duct 38, and/or overflow opening or duct 40, is fashioned according to one of the variants proposed in German patent application 103 38 527.4 of the present applicant. The connection or linkage of collection container 10 to first header 12 in the lower area, in particular in the area of the overflow opening or duct 40, can also be as proposed in German patent application 103 38 527.4 of the present applicant. Such a linkage or connection can also be present in the area of overflow opening 38.

Therefore, with regard to preferred constructions of the overflow opening or overflow duct 40, as well as of the overflow opening or overflow duct 38, as well as the linkage or connection of collection container 10 to header 12 in the lower area, in particular in the area of the overflow opening or overflow duct 40, and possibly also in the area of the overflow opening 38, reference is made to German patent application 103 38 527.4 of the present applicant, and the relevant disclosure in said patent application is hereby made part of the subject matter of the present disclosure through incorporation, with respect to preferred constructions.

The linkage or connection of collection container 12 to header 12 takes place at the top, preferably by means of the already-described annular holder 46, which is also described in further detail below.

In the construction according to FIG. 1, the length of collection container corresponds essentially to the length of first header 12, but may also deviate therefrom.

In a preferred construction, the outer diameter of second pipe 30 of collection container 10 corresponds essentially to the outer diameter of the first header.

Second pipe 30 and disk 58, which are fitted into one another and soldered to one another, can also be manufactured separately.

In the construction according to FIG. 1, the flow through dryer cartridge 44 is forced.

However, it can also be provided that the dryer cartridge or filter-dryer cartridge 44 is passively connected, as for example in the case of a solderable dryer. In this case, however, it is particularly preferably provided that an additional filter is integrated between inlet 38 into collection container 10 and outlet 40 from collection container 10.

In a preferred construction, it is provided that one or both overflow openings or overflow ducts 38, 40 are constructed according to one of the variants described below, it can for example be provided that collection container 30 and/or first header 12 have outwardly directed passages. These can for example have at their free ends essentially identical faces, and these faces can be placed against one another and soldered together. In such a construction, it can for example also be provided that, in particular in addition, these passages allocated to one another are surrounded by a sleeve, preferably a thickening one. It can also be provided that such a sleeve is situated on the inside. This is in particular a common sleeve for the passages allocated to one another. It can also be provided that the passages allocated to one another are dimensioned such that they can be telescopically inserted into one another and also pushed into one another. It can also be provided that first header 12 has a bore and collection container 10 has a passage that is pushed into this opening in order to form an overflow duct. The reverse can also be the case. It can also be provided that first header 12 and collection container 10 have stampings for the formation of an overflow opening or overflow duct. This can for example be such that they each have an outwardly directed annular surface, the two annular surfaces being placed against one another and soldered together.

It can also be provided that the connection or linkage or formation of such an overflow duct, in particular in the area of overflow duct 40, is possible, but also takes place in the area of overflow duct 38 via a short extruded profile that is inserted into a corresponding opening of first header 12, as well as into an opening of collection container 10, and is preferably soldered in each.

It can also be provided that such an extruded profile has a bulge that holds collection container 10 and first header 12 at a distance from one another, forming an intermediate gap. A gap between first header 12 and collection container 10 can also be produced in some other way.

In the construction according to FIG. 1, dryer or cartridge 44 is exchangeable. That is, it can be removed and exchanged for a different one. For this purpose, a detachable cover is provided in the area of the upper end of the collector; an exemplary embodiment of this cover is explained below on the basis of FIG. 2.

However, instead of such an exchangeable dryer a non-exchangeable dryer can be provided. This can for example also be a dryer cartridge 44, or can be constructed in some other way, being fixed inside the collection container in such a way that it cannot be removed or exchanged without destruction.

In addition, it is preferred that instead of an exchangeable dryer (dryer cartridge as well as filter), a solderable dryer is provided. Such a solderable dryer is described for example in German patent application DE 103 38 526.6 of the present applicant. With regard to such a solderable dryer, that is, a dryer that would not be destroyed or damaged in a soldering oven, reference is made to the embodiments in DE 103 38

526.6, which in this regard, as a preferred construction, is made part of the subject matter of the present disclosure with respect to preferred constructions of the present invention.

In the construction according to FIG. 1, it is provided that the exchangeable dryer can be removed for exchange upwardly.

In a preferred construction, the connection between first header 12 and collection container 10 can take place at the top in the manner described in German patent application 103 38 547.4 of the present applicant. Reference is explicitly made to the relevant embodiments in German patent application 103 38 527.4, and through reference they are made part of the subject matter of the present disclosure with respect to preferred constructions of the present invention.

The filter/dryer cartridge is accommodated in first pipe 28. First pipe 28 is situated above second pipe 30, i.e., facing the upper end of collection container 10.

FIG. 2 shows an upper segment of the construction according to FIG. 1 in an enlarged view, collection container 10 or first pipe 28 and first profile piece 32, as well as annular holder 46, being partially cut away, and the system being tilted slightly forward in relation to the construction according to FIG. 1.

As is shown in FIG. 2, a detachable seal 80 is provided by means of which second end 36, or upper end 36, of the collection container can be sealed. This detachable sealing element 80 is here fashioned as a stopper. Detachable seal 80 has on its outer surface two circumferential grooves at a distance from one another in the longitudinal direction, in each of which sealing devices fashioned as O-rings 82 are situated. Profile piece 32 has on its inner surface a sealing surface 21 for O-rings 82 of stopper 80.

In addition, in the inner surface of first profile piece 32 there is provided a circumferential groove 84 that can accept a securing ring.

For sealing, stopper or seal 80 is placed far enough into the first profile piece that a securing ring situated in groove 24 or subsequent thereto holds stopper or seal 80 in its sealing position. This securing ring can for example be removed using a suitable tool in order to release the seal and enable the dryer to be removed.

The seal can be prevented from falling into header 10 via suitable means, stops, or the like.

For this purpose, for example spacing elements or stops or force storage devices such as springs or the like can be provided.

First profile piece 32 has on its inner surface a circumferential beveling that for example enables a non-damaging introduction of the O-rings. Correspondingly, this beveling is situated above sealing surface of first profile piece 32, and/or underneath groove 84.

As is shown in FIG. 2, the wall thickness of the first profile piece is greater than the wall thickness of first pipe 28. There, this is such that the first profile piece terminates essentially flush with pipe 28 radially inwardly in the contact area between this first profile piece 32 and first pipe 28, and, radially externally, a continuation 25 is provided that conforms to the outer surface and that overlaps or sheaths pipe 28.

Here, pipe 28 is supported axially on first profile piece 32, first profile piece 32 being fitted onto first pipe 28.

Such a detachable seal 80 can, in particular alternatively, for example also be fashioned as a screw seal. Such a screw seal can for example be screwed into a threading provided on profile piece 32 in order to effect the seal. Groove 84 and the securing ring are then replaced by a threaded pair. Other constructions of a detachable seal, in particular provided on upper end 36 of collection container 10, are also preferred.

Detachable seal 80 enables in particular the removal or exchanging of the dryer or dryer cartridge. In constructions having a non-exchangeable and/or solderable dryer, upper end 26 can also be permanently sealed. For example, the annular holder can also be such that it does not have an annular opening in the area of the collection container, but rather sealed there complete from the covering of first end 36 of the collection container.

Figure 3:
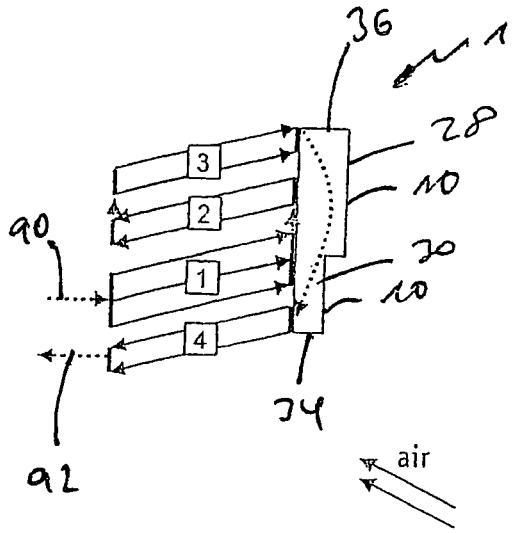
FIG. 3 shows a first exemplary flow guidance pattern that can be provided according to the present invention, in a schematic view.
Figure 4:
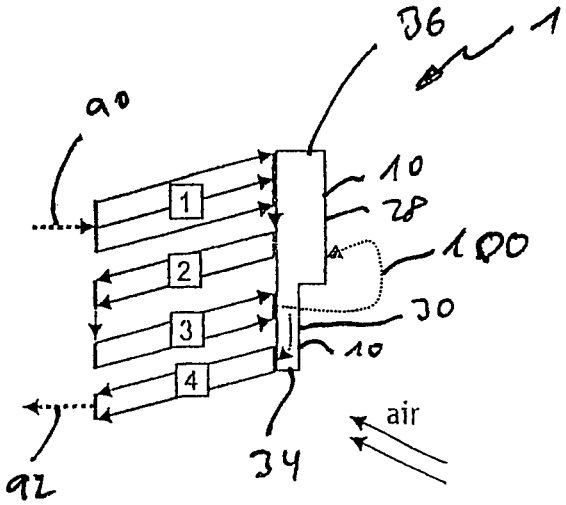
FIG. 4 shows a second exemplary flow guidance pattern that can be provided according to the present invention, in a schematic view.

FIGS. 3 and 4 show two exemplary variants according to which the flow through heat exchanger 1 can take place. Heat exchanger 1 is constructed in particular as a condenser, preferably as a refrigerant condenser. For simplification, in the following it is assumed that a refrigerant flows through this condenser.

The flow design shown in FIG. 3 is designated in the following as flow variant 1, and the flow design shown in FIG. 4, which can also be designated the classical design, is called flow variant 2 in the following.

The numerals shown in squares indicate schematically the sequence in which flow takes place through the pipes of the pipe-fin block.

The flow paths of those pipes of the pipe-fin block through which flow takes place in the same direction of flow, and that debouch into the same chamber of the first header as well as the same chamber of the second header, are designated the flow path of the condenser. These chambers are limited by the already-discussed separating walls inside the respective header.

Here, a plurality of pipes of the pipe-fin block can form a flow path, or one pipe of this pipe-fin block can form the path. The same number of pipes of the pipe-fin block can be allocated to each of a number of different flow paths. This number of pipes allocated can also be different. Combinations are also possible.

The last cooling path of the condenser is designated the sub-cooling path, i.e., the cooling path through which flow takes place last before the refrigerant exits from the condenser.

The opening or openings through which the refrigerant enters into the condenser is designated the hot gas inlet; the flow path that is the first through which refrigerant flows after entry is designated the hot gas segment.

Air flows through the pipes of the pipe-fin block transverse to the flow paths; this is indicated schematically by the arrow "air."

In the first flow variant shown schematically in FIG. 3, the hot gas inlet and the sub-cooling path are directly adjacent to one another. Viewed from the inlet, the refrigerant first flows upward. Here, the refrigerant flows between the headers multiple times; that is, multiple times back and forth. In the construction according to FIG. 3, this is shown in such a way that flow takes place in opposite directions through successive flow paths of the condenser, in the upward direction. According to the exemplary schematic presentation shown in FIG. 3, three flow paths are provided for this purpose, through which flow takes place back and forth. However, more or fewer flow paths can also be provided. The next-to-last flow path of the condenser is situated at the upper end of the condenser. Subsequently, i.e., after flow has taken place through the next-to-last flow path, the refrigerant enters into the collection container, it being provided in particular that after flowing through the next-to-last flow path the refrigerant enters into the first header, and from there flows into collection container 10. The sub-cooling path, that is, the last flow path of the condenser, is situated at the lower end of the condenser. The exit of the refrigerant from the condenser takes place from here. Here it can preferably be provided that the refrigerant enters into collection container 10 in the upper area, and exits collection container 10 in the lower area in tile direction of the last flow path.

The entry and exiting of the refrigerant is schematically shown in FIGS. 3 and 4 by arrows 90 and 92.

In the second flow variant shown in FIG. 4, which in particular corresponds to the classical design, the hot gas inlet is situated at the top of the condenser, and the sub-cooling path is situated at the bottom of the condenser. Here, the refrigerant flows from the next-to-last flow path of the condenser through a connecting pipe that is schematically indicated by arrow 100 into collection container 10, it being provided in particular that it flows through first header 12 before entering collection container 10. The inlet opening or inlet bore in collection container 10 is situated above the sealing lip, in particular if an exchangeable dryer or exchangeable filter-dryer cartridge is provided.

In the heat exchanger shown in FIG. 1, the first flow variant is preferably provided. This is in particular the case because overflow opening 38 is situated relatively far towards the top of first header 12. However, it is to be noted that the construction according to FIG. 1 can also be such that the second flow variant is provided there. In particular, for this purpose the overflow duct or opening 38 shown in FIG. 1 can have a different construction, such that the medium or refrigerant exits first header 12 further down, and is conducted via a pipe 100 into the area of collection container 10 that is situated above sealing lip 42, and enters the collection container there, above sealing lip 42. Such constructions are shown below on the basis of subsequent Figures.

Figure 5:
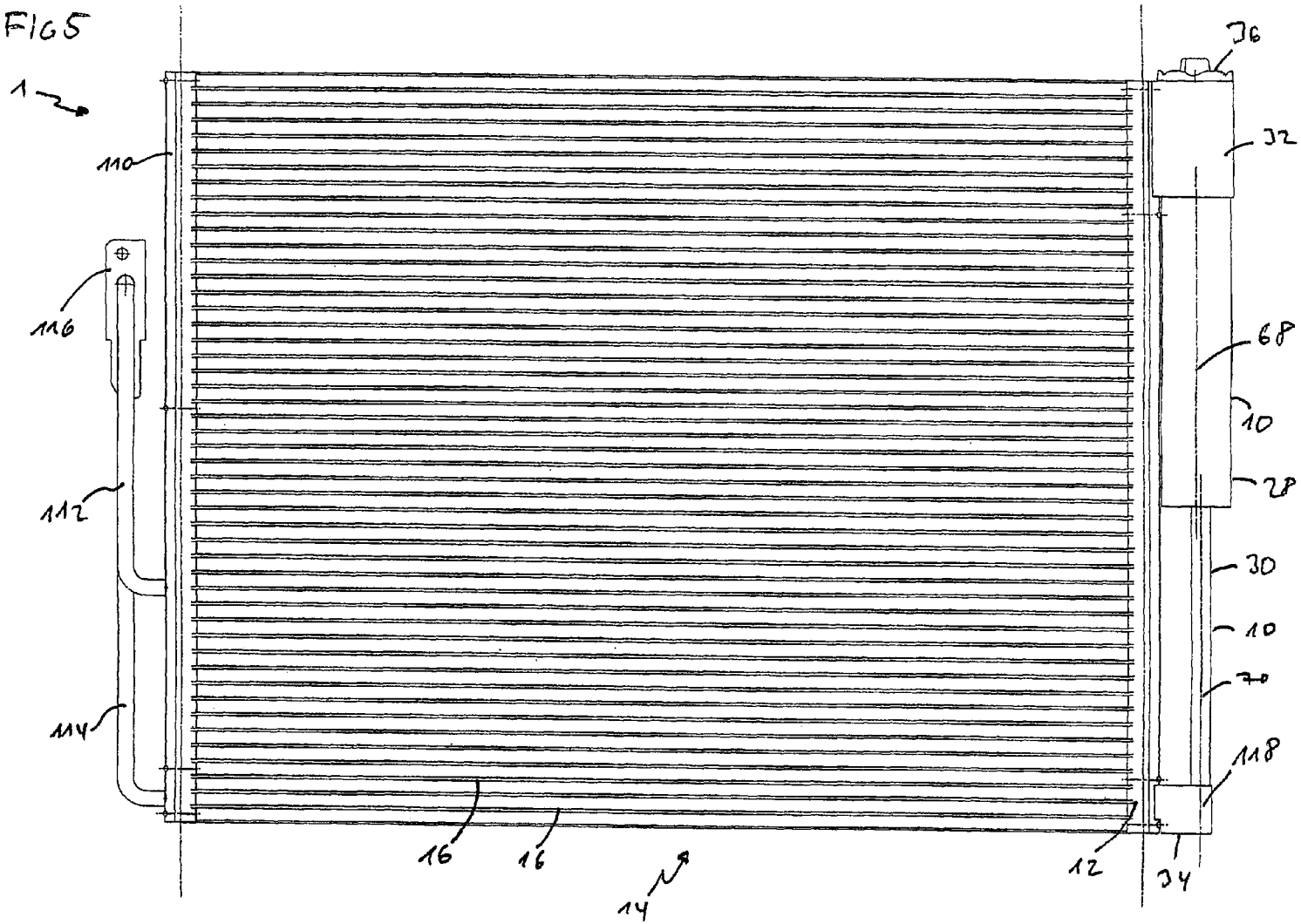
FIG. 5 shows an exemplary specific embodiment of the present invention in a schematic view.

FIG. 5 shows an exemplary specific embodiment of the present invention in a schematic representation.

FIG. 5 also shows second header 110 of the heat exchanger. Via conduit 112, the medium or refrigerant is supplied to heat exchanger or condenser 1, and via conduit 114 the medium or refrigerant is conducted out of heat exchanger or condenser 1.

In addition, in FIG. 5 a holding device is shown by means of which the condenser can be held or mounted.

In the construction according to FIG. 5, second pipe 30 is also situated eccentrically in relation to first pipe 28 of collection container 10, but central longitudinal axis 70 of second pipe 30 of collection container 10 is situated further away from the central longitudinal axis of the first header than central longitudinal axis 68 of second pipe 28.

Figure 6:
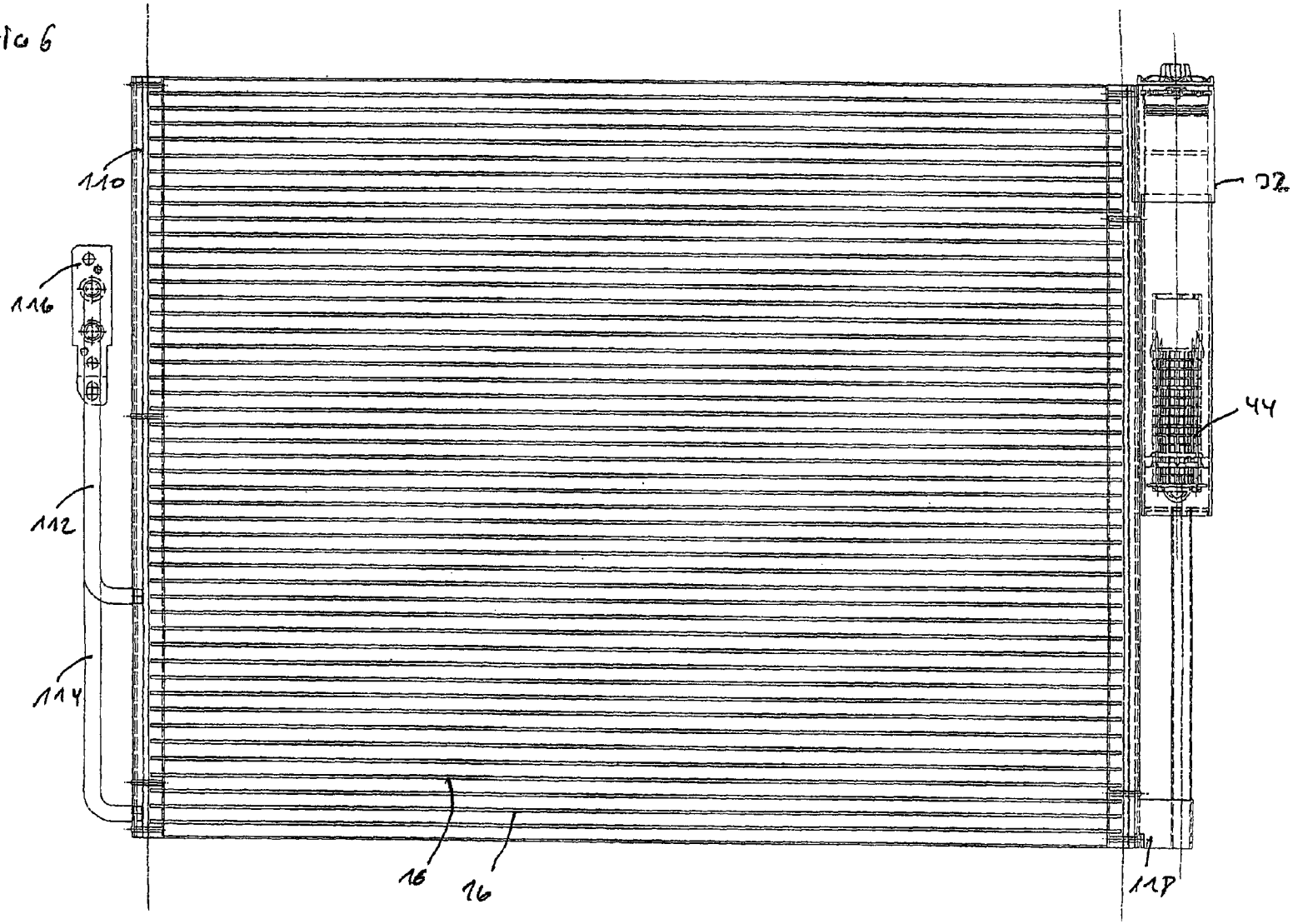
FIG. 6 shows the construction according to FIG. 5.

FIG. 6 shows the construction according to FIG. 5, with a view of the interior of collection container 10. Cartridge 44 can be seen there.

The overflow opening or overflow duct through which the medium or refrigerant exits collection container 10, or enters header 12, is here formed as connecting piece 118.

Figures 7, 8, 9:
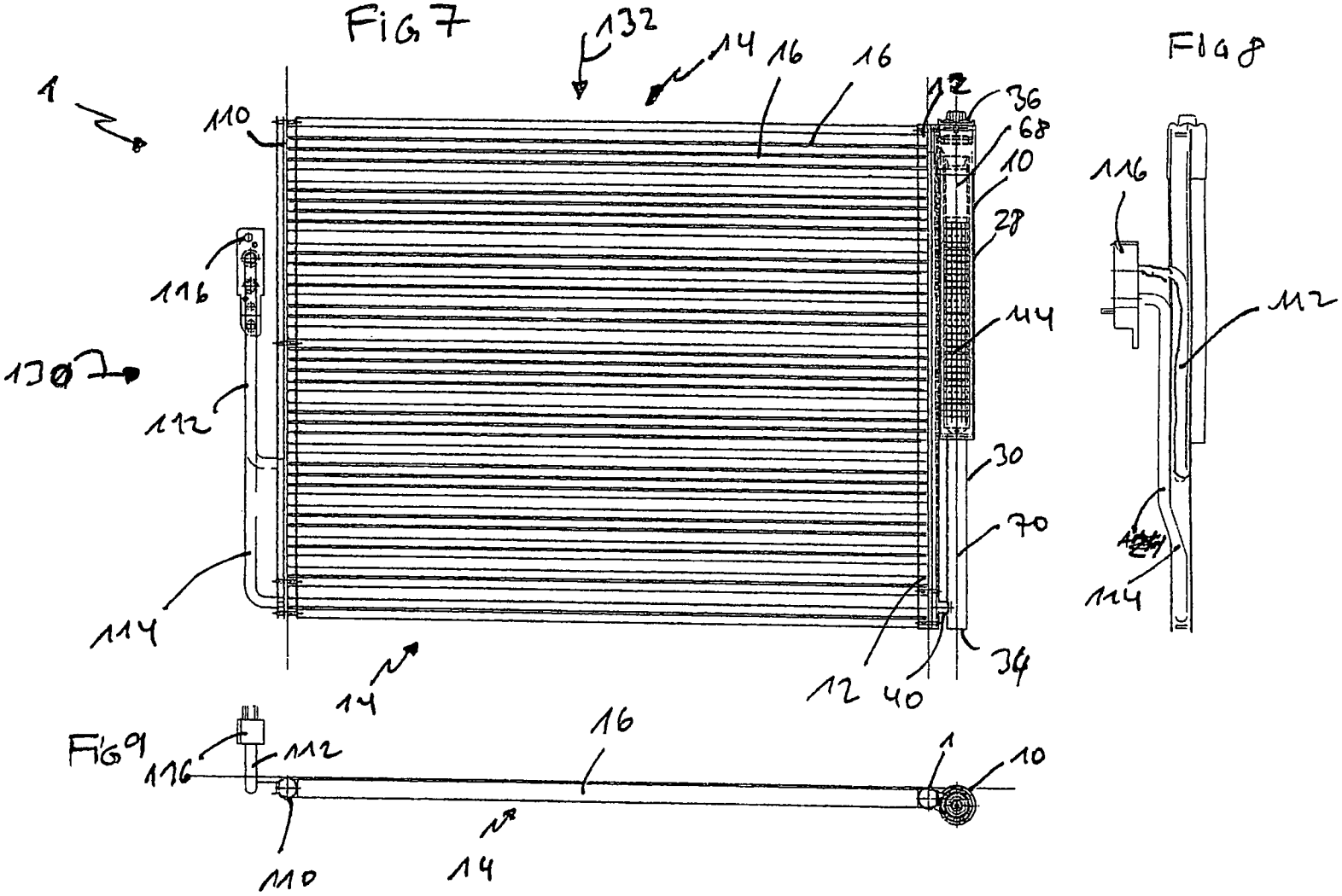
FIG. 7 shows an exemplary specific embodiment of the present invention in a schematic view.
FIG. 8 shows a side view of the construction according to FIG. 6.
FIG. 9 shows the construction according to FIG. 6 in a top view.

FIG. 7 shows an exemplary specific embodiment of the present invention in a schematic representation.

In this construction, the first flow variant is provided.

Differing from the construction according to FIGS. 1 and 5, second pipe 30 of collection container 10 is situated essentially concentrically to first pipe 28 of collection container 10.

Figure 10:
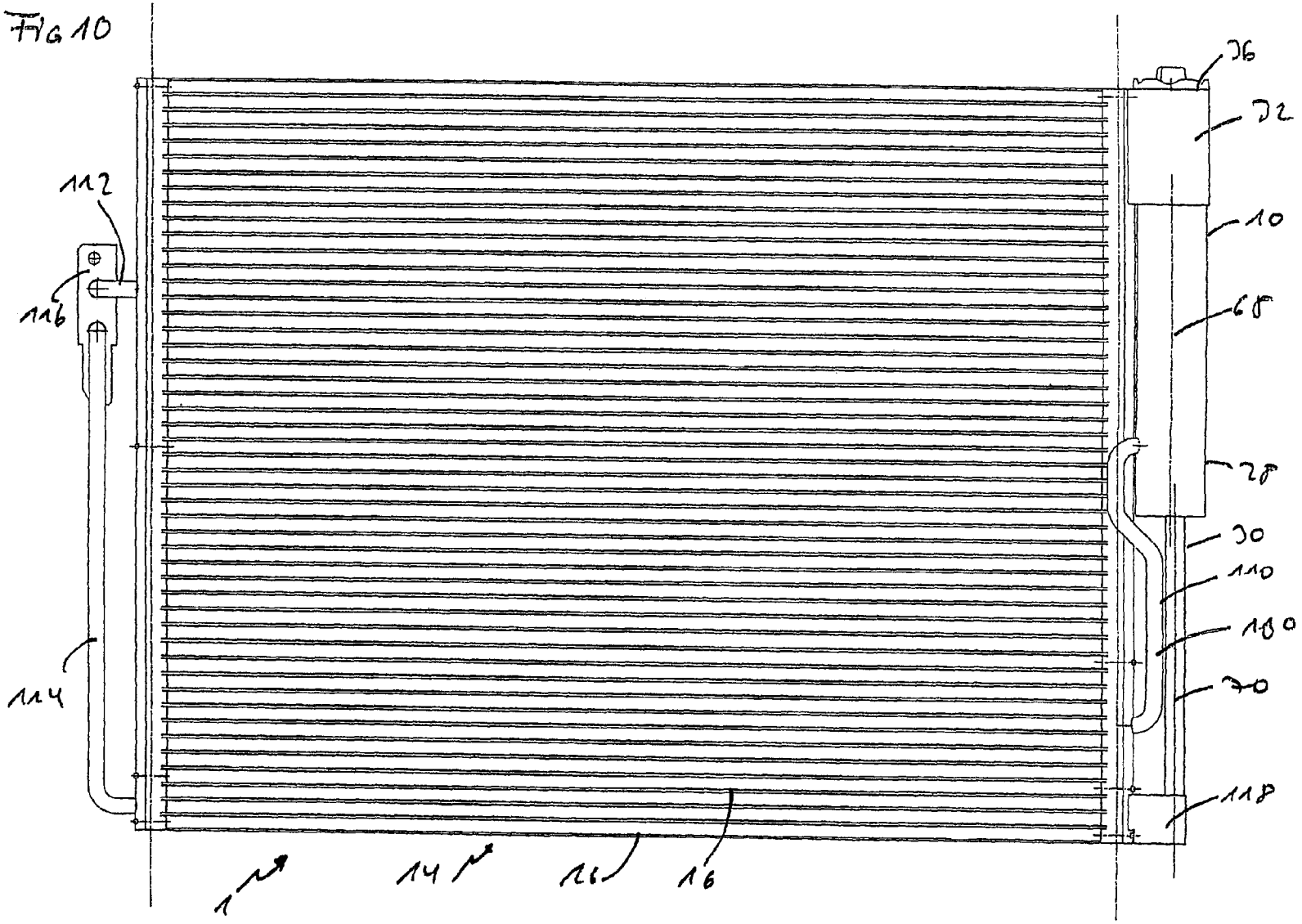
FIG. 10 shows an exemplary specific embodiment of the present invention in a schematic view.

FIG. 8 shows a side view of the construction according to FIG. 7 in the direction of view of arrow 130. FIG. 9 shows a top view of the construction according to FIG. 8 from the direction of view of arrow 132. FIG. 10 shows an exemplary specific embodiment of the present invention in a schematic representation. There, a heat exchanger or condenser according to the present invention is shown having a collection container 10 according to the present invention.

In this construction, flow variant 2 is provided.

Second pipe 30 of collection container 10 is situated eccentrically to first pipe 28 of collection container 10. Connecting pipe 110 is constructed with multiple curves, and has straight segments.

Figure 11:
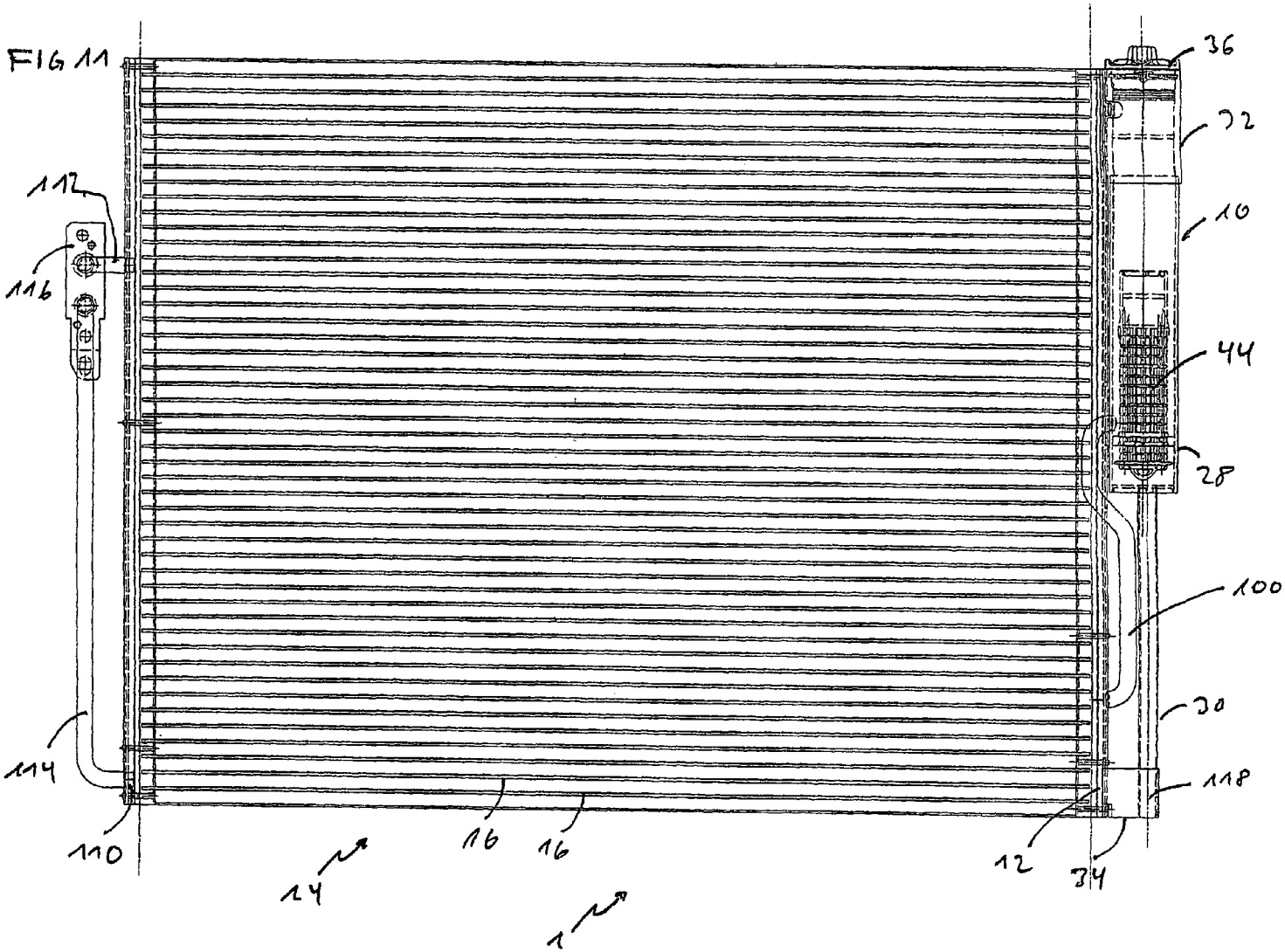
FIG. 11 shows the construction according to FIG. 10.

FIG. 11 shows the construction according to FIG. 10, providing a view into the interior of collection container 10.

FIG. 11 shows an exemplary specific embodiment of the present invention in a schematic representation.

In heat exchanger 1 according to FIG. 11, the second flow variant is provided. The construction according to FIG. 12 differs from that shown in FIGS. 10 and 11 essentially in the construction of connecting pipe 100, and in that second pipe 30 of collection container 10 is situated essentially concentrically to first pipe 28 of collection container 10. In addition, the construction according to FIG. 12 differs from that according to FIGS. 10 and 11 in that the difference between the outer diameter of pipe 28 and the outer diameter of pipe 30 is less than in the construction according to FIGS. 10 and 11.

Figures 17, 18, 19:
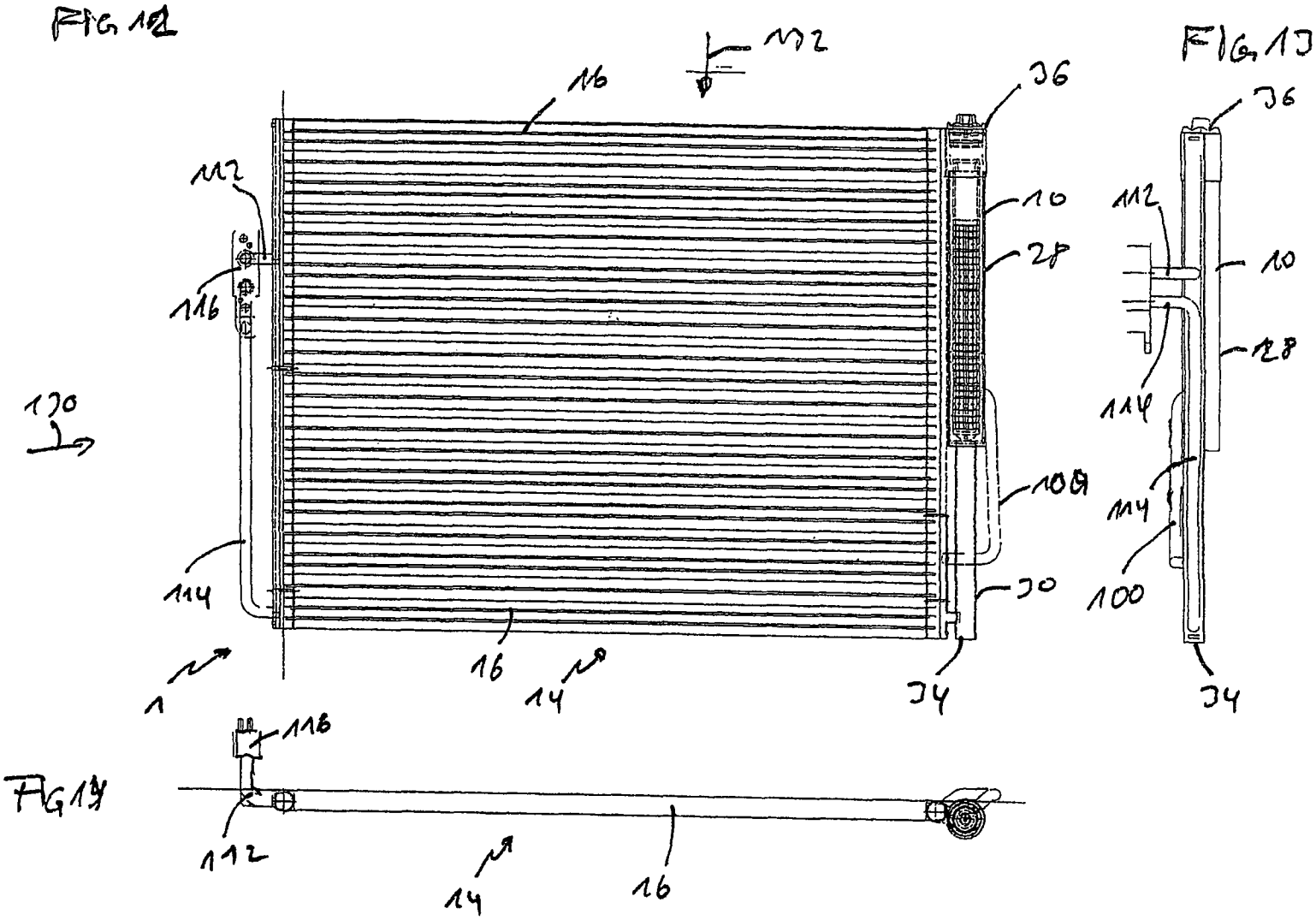
FIG. 17 shows a three-dimensional view of the construction according to FIGS. 12 to 14.
FIG. 18 shows another three-dimensional view of the construction according to FIGS. 12 to 14.
FIG. 19 shows another exemplary specific embodiment having a double flange.

FIG. 19 shows another exemplary specific embodiment of the present invention, in which it has a flange, in particular a double flange 119. This double flange, which can preferably form an assembly with pipes 30 and 28 of collection container 10, is used to connect the overflow openings of the header to the connecting pipe 100 and to second pipe 30. In this way, in particular a simplified assembly of the individual components (first pipe 28, connecting pipe 100) to second pipe 30 can be effected.

It is also within the scope of the present invention to select the outer diameter of pipes 28 and 30 such that the outer diameter of pipe 28 is smaller than that of pipe 30. Thus, the thicker part of the collector is situated at the bottom and the narrower part is situated at the top.

FIG. 13 shows a side view of the construction according to FIG. 12, from the point of view of arrow 130.

FIG. 14 shows the construction according to FIG. 13 in a top view from the point of view of arrow 130.

Figure 15:
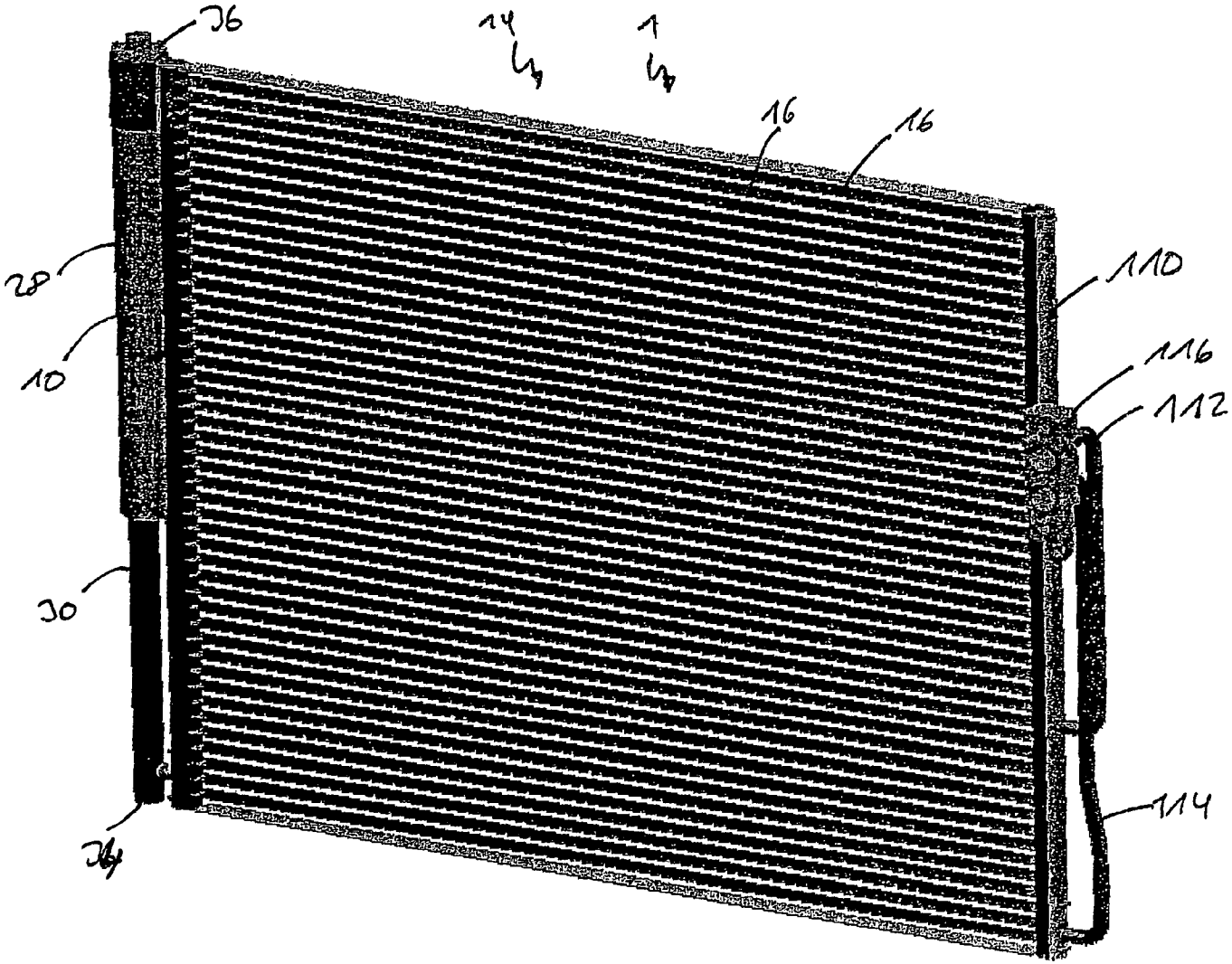
FIG. 15 shows a three-dimensional view of the construction according to FIGS. 7 to 9.
Figure 16:
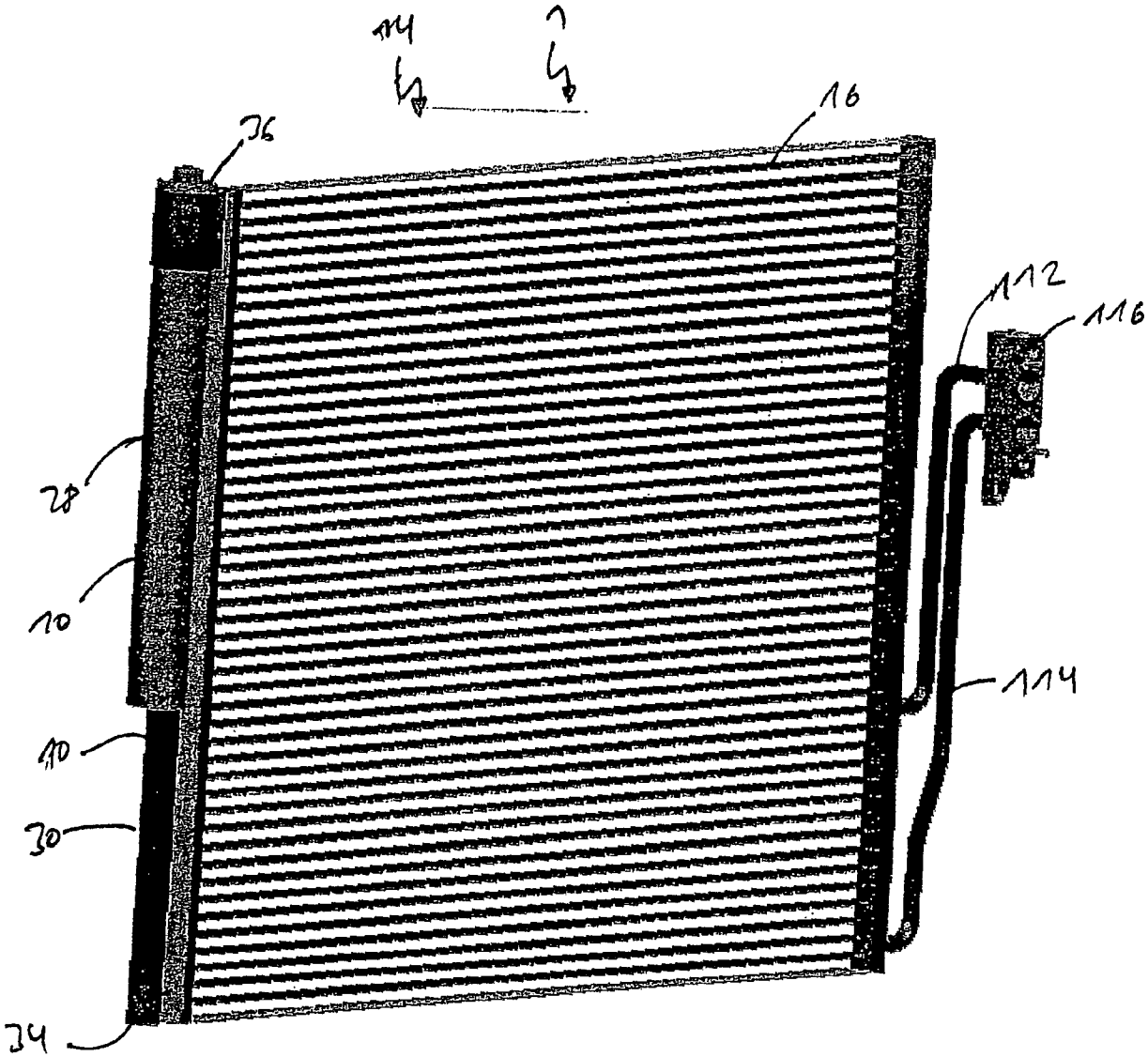
FIG. 16 shows another three-dimensional view of the construction according to FIGS. 7 to 9.
Figure 17:
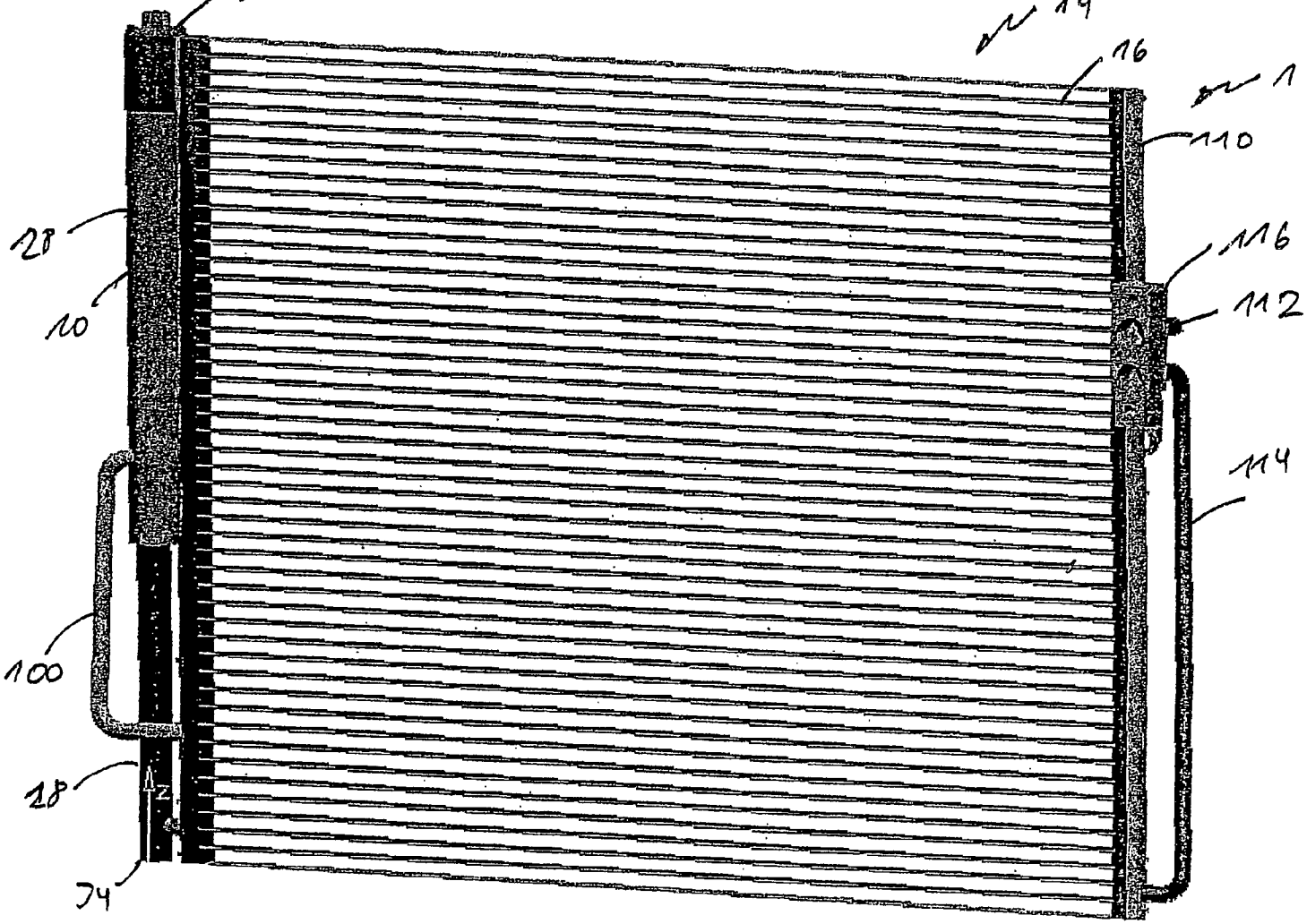
Figure 18:
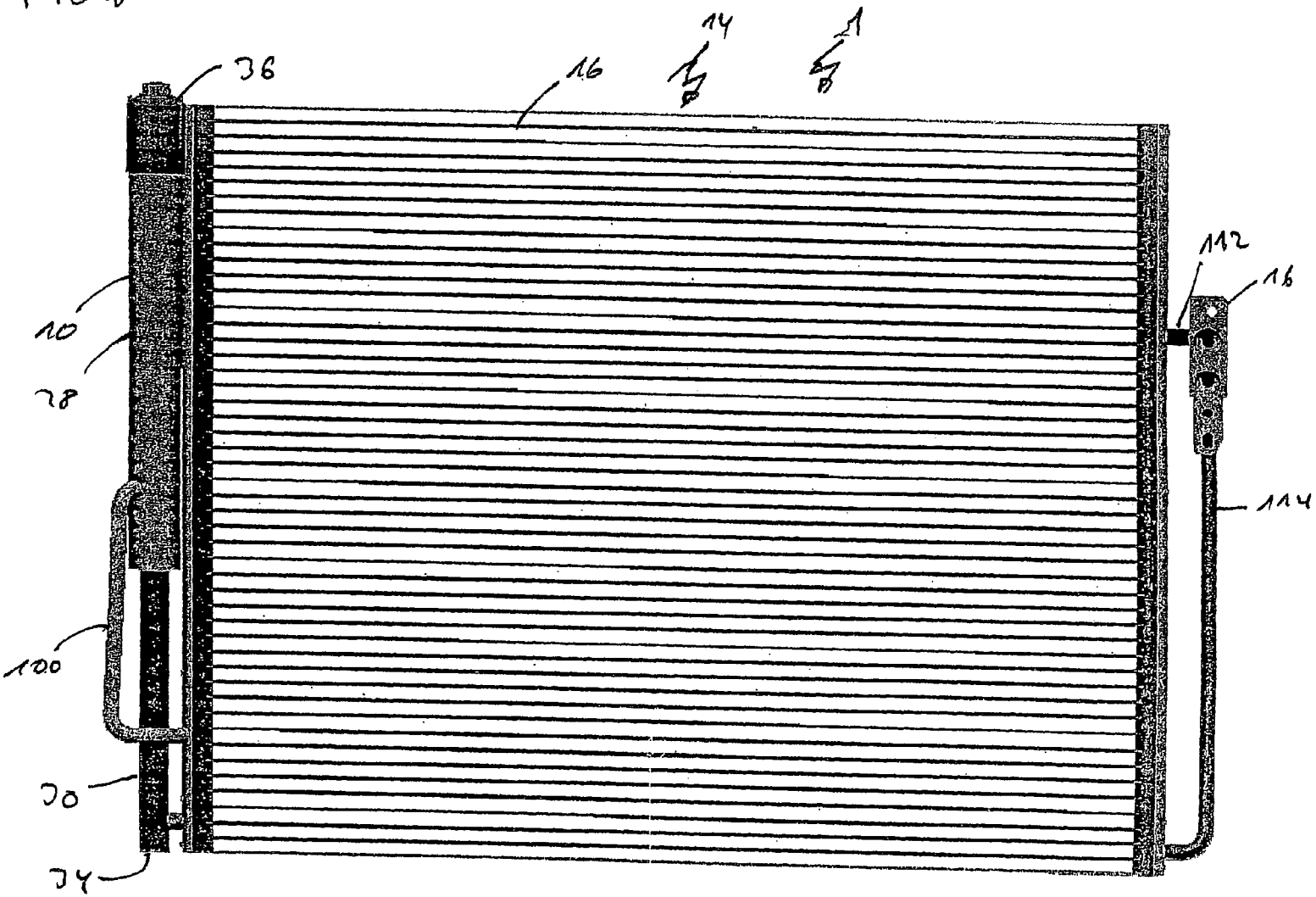
Figure 19:
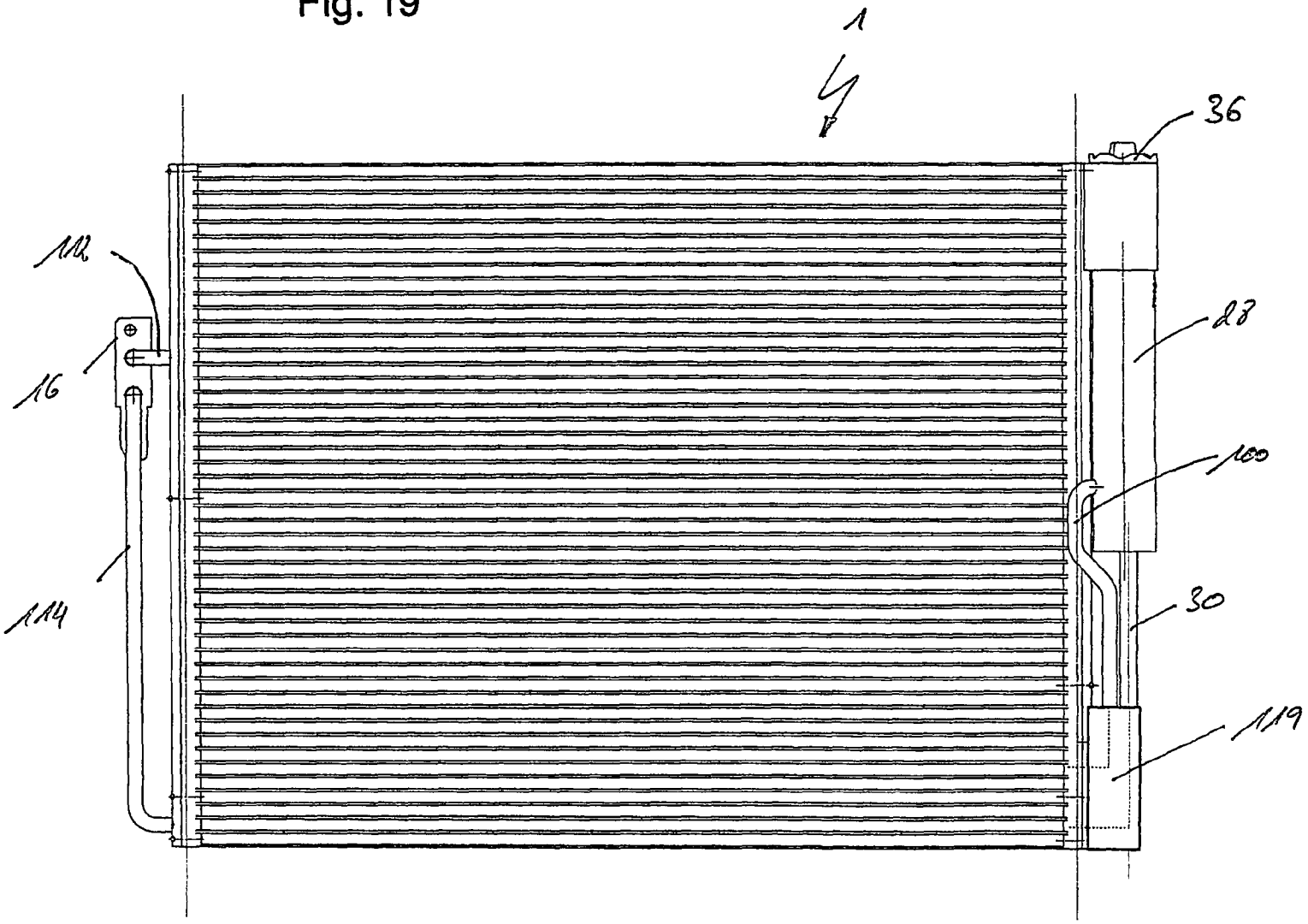

FIGS. 15 and 16 show three-dimensional views of the construction according to FIGS. 7-9.

FIGS. 17 and 18 show three-dimensional views of the construction according to FIGS. 12-14, in which the second flow variant is provided.

FIG. 19 shows another exemplary specific embodiment of the present invention, realized with a flange, in particular a double flange 119. This double flange, which preferably forms an assembly having at least pipes 30, 28, and 100 of the collection container, is used to connect the overflow openings of the header to connecting pipe 100 and to second pipe 30. In this way, in particular a simplified assembly of the individual components (first pipe 28, connecting pipe 100) to second pipe 30 can be provided.

The invention claimed is:

1. A collection container for a heat exchanger, the collection container comprising:

at least one inlet opening for a fluid, in particular refrigerant;

at least one outlet opening for the fluid; and a first pipe and a second pipe axially adjacent to said first pipe; and a filter cartridge extending the length of said first pipe, said first pipe including an outer jacket configured to limit a cross-sectional surface of an internal chamber in each of a number of cross-sections being perpendicular to a longitudinal direction of the first pipe, wherein at least two of the cross-sections are progressively smaller in size in the longitudinal direction toward said second pipe and are situated at a distance from one another in the longitudinal direction.

2. The collection container as recited in claim 1, wherein a first contiguous area of the collection container extends in the longitudinal direction over at least 30 mm in which the cross-sectional surfaces of the internal chamber, limited by the outer jacket and situated perpendicular to the longitudinal direction, each have an essentially equally large cross-sectional surface, and a second contiguous area of the collection container differs from the first contiguous area and extends in the longitudinal direction over at least 30 mm and is situated perpendicular to the longitudinal direction each having an essentially equally large cross-sectional surface, the surface content of the cross-sectional surfaces in the first contiguous area being greater than the surface content of the cross-sectional surfaces in the second contiguous area.

3. The collection container as recited in claim 1, wherein the surface content of the larger of the cross-sectional surfaces of the internal chamber is at least twice as large as the surface content of the smaller of the cross-sectional surfaces of the internal chamber.

4. The collection container as recited in claim 1, wherein the outer jacket has one or more segments in the longitudinal direction in which the outer surface of the outer jacket is round or cylindrically shaped in the longitudinal direction, and along the overall length of the collection container, the outer jacket has at least two outer diameters that are different sizes.

5. The collection container as recited in claim 4, wherein the outer diameter of the outer jacket is essentially constant, and the outer diameter in the first contiguous area is larger than the outer diameter in the second contiguous area.

6. The collection container as recited in claim 4, wherein the larger of the outer diameters is longer than the smaller of the outer diameters by at least 10 millimeters or at least 30%.

7. The collection container as recited in claim 6, wherein the difference between the larger of the outer diameters and the smaller of the outer diameters is in a range between 15 mm and 40 mm.

8. The collection container as recited in claim 1, wherein the collection container is limited radially externally in at least one segment by a plurality of pipe-shaped parts that extend in the longitudinal direction and are situated at a distance from one another in the longitudinal direction, each having an essentially cylindrical inner surface, the inner diameter of at least one of these pipe-shaped parts being larger than the inner diameter of at least one other of these pipe-shaped parts.

9. The collection container as recited in claim 8, wherein a first contiguous area of the collection container extends in the longitudinal direction over at least 30 mm, in which the inner diameter of one of these pipe-shaped parts is essentially constant, and a second contiguous area of the collection container differs from the first contiguous area and extends in the longitudinal direction over at least 30 mm, in which the inner diameter of the other of these pipe-shaped parts is essentially constant, the inner diameter in the first contiguous area being larger than this inner diameter in the second contiguous area.

10. The collection container as recited in claim 8, wherein the larger of the inner diameters is longer than the smaller of the inner diameters by at least 10 mm or at least 30%.

11. The collection container as recited in claim 1, the collection container being outwardly radially limited by a plurality of pipe-shaped parts that extend in the longitudinal direction of the collection container and that are situated at a distance from one another in the longitudinal direction, at least one of these pipe-shaped parts being situated eccentrically relative to at least one other of these pipe-shaped parts.

12. The collection container as recited in claim 1, wherein the outer jacket is formed by a plurality of pipe-shaped parts.

13. The collection container as recited in claim 1, wherein the outlet opening is situated in one of: a first end area, a lower end area, and the jacket wall.

14. The collection container as recited in claim 1, wherein at least an area of the outerjacket wall the maximum outer dimension of the outer jacket is less than 25 mm.

15. The collection container as recited in claim 1, further comprising at least one of a dryer and a filter device.

16. The collection container as recited in claim 1, further comprising a detachable seal device is provided in the area of at least one of the second end and the upper end of the collection container, facing away from a first axial end of the collection container.

17. The collection container as recited in claim 1, further comprising a plurality of pipes that succeed one another in the longitudinal direction in order to form an outer jacket of the collection container, said pipes being connected to one another in fluid-tight fashion, at least one of these pipes being partly covered by a wall segment in the frontal end area facing the other of these pipes, in particular in an area situated radially outside the other of these pipes.

18. The collection container as recited in claim 17, wherein the wall segment by means of which a frontal end area of a pipe is partly covered extends essentially perpendicular to the longitudinal axis of the collection container.

19. The collection container for a heat exchanger as recited in claim 1, the collection container having a plurality of pipes succeed one another in the longitudinal direction in order to form an outer jacket of the collection container, said pipes being connected to one another in particular in essentially fluid-tight fashion and in particular so as to form an outer jacket of the collection container, two such successive pipes being connected to one another in an area that, seen in the longitudinal direction of the collection container, is situated at a distance from both ends of the collection container that is at least 20% of the overall length of the collection container.

20. The collection container as recited in claim 1, further comprising two pipes, of which one is inserted with one of its two ends into an end of the other pipe.

21. The collection container as recited in claim 1, further comprising two pipes of which at least the first is closed at an end face by a sealing element or wall segment, said sealing element having an opening into which the second pipe debouches with one of its ends or end areas, so that a fluid connection of the internal chambers of these pipes is produced.

22. The collection container as recited in claim 21, wherein the sealing element or wall segment is a disk or a cover.

23. The collection container as recited in claim 22, wherein the disk is connected fixedly to a second pipe of the collection container, and is inserted into the first pipe and connected thereto by soldering.

24. The collection container as recited in claim 23, wherein one of the second pipe or the area of the second pipe protrude from the first pipe and forms a segment of the jacket of the collection container, and has a length between 50 mm and 300 mm.

25. A heat exchanger, in particular refrigerant condenser of a motor vehicle, characterized in that this heat exchanger has a collection container as recited in claim 24.

26. The heat exchanger as recited in claim 25, further comprising a pipe block or pipe/fin block having a multiplicity of pipes that are essentially parallel at least in segments, and possibly having fins situated between the pipes, the first ends being received by a first header, and the collection container being situated parallel to said first header, and the first header having at least two openings of which one is fluidically connected to the inlet opening of the collection container and one is fluidically connected to the outlet opening of the collection container, so that an overflow opening or overflow ducts are formed in order to enable a flow of fluid or refrigerant from the first header into the collection container and vice versa.

27. The heat exchanger as recited in claim 26, further comprising a second header that accepts the second ends of the pipes of the pipe block or pipe/fin block.

28. The heat exchanger as recited in claim 26, wherein the pipes, in particular all the pipes, of the pipe or pipe/fin block have a straight construction.

29. The heat exchanger as recited in claim 25, wherein the heat exchanger is a refrigerant condenser, and includes separating walls in the first header and in the second header that are situated such that the medium, in particular refrigerant, flows back and forth between the first and second headers through the pipes of the pipe/fin block multiple times.

30. The heat exchanger as recited in claim 25, having two headers that are fluidically connected, in particular connected in terms of refrigerant, via the pipes of a pipe/fin block, separating walls being situated in the headers in order to form separate chambers in each header, wherein the hot gas inlet and the sub-cooling path are situated immediately adjacent to one another.

31. The heat exchanger as recited in claim 25, having two headers that are fluidically connected, in particular in terms of refrigerant, via the pipes of a pipe/fin block, separating walls being situated in the headers in order to form separate chambers in each header, characterized in that the fluid or refrigerant from the inlet or hot gas inlet of the condenser first flows upward.

32. The heat exchanger as recited in claim 31, wherein the next-to-last flow path of the condenser is situated at the upper end of the condenser.

33. The heat exchanger as recited in claim 31, wherein the last flow path of the condenser is situated at the lower end of the condenser.

34. The heat exchanger as recited in claim 33, wherein after flowing through the next-to-last flow path, and before flowing through the last flow path, the fluid or refrigerant flows through the collection container.

* * * * *